US010975517B2

(12) United States Patent
Nakamura

(10) Patent No.: US 10,975,517 B2
(45) Date of Patent: Apr. 13, 2021

(54) CLOTH SPREADING APPARATUS

(71) Applicant: PUREX CO., LTD., Takamatsu (JP)

(72) Inventor: Yoshiteru Nakamura, Takamatsu (JP)

(73) Assignee: PUREX CO., LTD., Takamatsu (JP)

( * ) Notice: Subject to any disclaimer, the term of this patent is extended or adjusted under 35 U.S.C. 154(b) by 145 days.

(21) Appl. No.: 16/466,705

(22) PCT Filed: Nov. 20, 2017

(86) PCT No.: PCT/JP2017/041613
§ 371 (c)(1),
(2) Date: Jun. 5, 2019

(87) PCT Pub. No.: WO2018/105363
PCT Pub. Date: Jun. 14, 2018

(65) Prior Publication Data

US 2019/0301081 A1 Oct. 3, 2019

(30) Foreign Application Priority Data

Dec. 9, 2016 (JP) ..... JP2016-239768

(51) Int. Cl.
*D06F 67/04* (2006.01)
*D06C 3/00* (2006.01)

(52) U.S. Cl.
CPC ..... *D06F 67/04* (2013.01); *D06C 3/00* (2013.01)

(58) Field of Classification Search
CPC ..... D06F 67/00; D06F 67/04; D06F 89/00; D06C 3/00
See application file for complete search history.

(56) References Cited

U.S. PATENT DOCUMENTS 3,568,341 A * 3/1971 Buss ..... D06F 67/04 38/143
3,729,846 A * 5/1973 Weir ..... D06F 67/04 38/143

(Continued)

FOREIGN PATENT DOCUMENTS

DE 1785548 B 1/1971
DE 2121462 A1 * 11/1971

(Continued)

OTHER PUBLICATIONS

Dec. 19, 2017 International Search Report issued in International Patent Application No. PCT/JP2017/041613.

(Continued)

*Primary Examiner* — Ismael Izaguirre
(74) *Attorney, Agent, or Firm* — Oliff PLC

(57) ABSTRACT

Provided is a cloth spreading apparatus in which a pair of feeder chucks are engaged with adjacent corners of a piece of cloth at a lowered position, and raise the cloth to a traversing position of spreading chucks; the pair of spreading chucks traverse to positions closer to each other to receive the adjacent corners of the cloth from the feeder chucks, and then traverse to positions farther away from each other to pull the adjacent corners so as to spread the cloth; an intermediate movable body receives, at an advanced position, an upper end portion of the spread cloth from the spreading chucks and retains the upper end portion, and then releases the upper end portion while moving to a retracted position so as to transfer the cloth onto a belt conveyor; and the belt conveyor carries out the cloth in a spread state, wherein the intermediate movable body has: a rear-facing surface that is a part of an upper surface between a front part and a sunken part located at a lower level than the front part, and that extends downward; a clamp that is placed opposite to the rear-facing surface; and a clamp (Continued)

driving device that advances and retracts the clamp to and from the rear-facing surface so as to hold an upper portion of the cloth between the clamp and the rear-facing surface and release the upper portion from therebetween.

4 Claims, 10 Drawing Sheets

(56) References Cited

U.S. PATENT DOCUMENTS 4,437,247 A * 3/1984 Wiebesiek ..... D06F 67/04 38/143
5,815,963 A * 10/1998 Rauch ..... D06F 67/04 38/143
2010/0024260 A1* 2/2010 Nielsen ..... D06F 67/04 38/143
2017/0204555 A1 7/2017 Tanii

FOREIGN PATENT DOCUMENTS

| | | | |
|---|---|---|---|
| JP | 2002-113295 | A | 4/2002 |
| JP | 2007-159921 | A | 6/2007 |
| JP | 2012-082038 | A | 4/2012 |
| JP | 2016-033271 | A | 3/2016 |
| WO | 2016/017090 | A1 | 2/2016 |

OTHER PUBLICATIONS

Nov. 22, 2019 Extended European Search Report issued in European Patent Application No. 17878277.7.

* cited by examiner (IV)

(III)

(VI)

(V)

(1)

(2)

(3)

(4)

(5)

(6)

CLOTH SPREADING APPARATUS

TECHNICAL FIELD

The present invention relates to a cloth spreading apparatus that is used when spreading, one by one, pieces of cloth having been washed at a cloth washing factory etc., to feed the cloth into an iron roller (also called a roll ironer).

BACKGROUND ART

Examples of known conventional cloth spreading apparatuses include the one described in Patent Literature 1 that has been disclosed before by the present applicant. This cloth spreading apparatus includes: a pair of feeder chucks that grasp adjacent corners of a washed piece of cloth; a raising-lowering device that raises and lowers the pair of feeder chucks; a pair of spreading chucks that receive the cloth from the pair of feeder chucks at a raised position of the feeder chucks and grasp the adjacent corners of the cloth; a traversing device that causes the pair of spreading chucks to traverse; an intermediate movable body on an upper surface of which an upper end portion of the cloth is retained; an advancing-retracting device that advances and retracts the intermediate movable body; and a belt conveyor that carries out the spread cloth.

In this conventional cloth spreading apparatus, the pair of feeder chucks are engaged with adjacent corners of a washed piece of cloth at a lowered position, directly by a worker or through a cloth supply device, and raise the cloth to a traversing position of the spreading chucks. The pair of spreading chucks traverse to positions closer to each other to receive the adjacent corners of the cloth from the feeder chucks, and then traverse to positions farther away from each other to pull the adjacent corners so as to spread the cloth. The intermediate movable body receives, at an advanced position, an upper end portion of the spread cloth from the spreading chucks onto an upper surface of a front part thereof, sucks and retains the upper end portion by a negative pressure, and then stops the negative pressure and releases the upper end portion of the cloth while moving to a retracted position, so as to transfer the cloth onto a front part of the belt conveyor. The belt conveyor carries out the received cloth in a spread state toward an iron roller.

CITATION LIST

Patent Literature

Patent Literature 1: Japanese Patent Laid-Open No. 2016-033271

SUMMARY OF INVENTION

Technical Problem

Further research conducted by the present inventor on the above conventional cloth spreading apparatus has found the following problem: since a negative pressure exerted by the intermediate movable body on the upper surface of the front part thereof is used to retain an upper end portion of a piece of cloth, this cloth spreading apparatus has difficulty in securely retaining a received piece of cloth and reliably transferring the cloth onto the belt conveyor at a predetermined position, in such cases as where an especially heavy piece of cloth is to be passed or where especially the operation speed is raised to enhance the efficiency of supplying cloth to an iron roller.

To solve this problem, the present inventor has considered providing a swinging clamp on an upper surface of a front part of a vacuum box, and opening and closing this vacuum box so as to retain an upper end portion of a piece of cloth by the swinging clamp and a negative pressure exerted by the vacuum box on the upper surface of the front part thereof. While this is effective to some extent, the retention is still not secure enough, so that an upper end portion of a piece of cloth slips while being retained and the cloth cannot be transferred onto the belt conveyor at a predetermined position, thus leaving room for improvement.

Solution to Problem

The present invention advantageously solves the problem with the conventional cloth spreading apparatus as described above. A cloth spreading apparatus of the present invention includes: a pair of feeder chucks that grasp adjacent corners of a washed piece of cloth; a raising-lowering device that raises and lowers the pair of feeder chucks; a pair of spreading chucks that receive the cloth from the pair of feeder chucks at a raised position of the feeder chucks and grasp the adjacent corners of the cloth; a traversing device that causes the pair of spreading chucks to traverse; an intermediate movable body on an upper surface of which an upper end portion of the cloth is retained; an advancing-retracting device that advances and retracts the intermediate movable body; and a belt conveyor that carries out the spread cloth.

In this cloth spreading apparatus, the pair of feeder chucks are engaged with adjacent corners of a washed piece of cloth at a lowered position, and raise the cloth to a traversing position of the spreading chucks; the pair of spreading chucks traverse to positions closer to each other to receive the adjacent corners of the cloth from the feeder chucks, and then traverse to positions farther away from each other to pull the adjacent corners so as to spread the cloth; the intermediate movable body receives, at an advanced position, an upper end portion of the spread cloth from the spreading chucks onto an upper surface and retains the upper end portion, and then releases the upper end portion of the cloth while moving to a retracted position so as to transfer the cloth onto a front part of the belt conveyor; and the belt conveyor carries out the received cloth in a spread state.

The intermediate movable body has:

- a rear-facing surface that is a part of the upper surface between a front part and a sunken part located at a lower level than the front part, and that extends downward from the front part toward the sunken part;
- a clamp that is placed opposite to the rear-facing surface; and
- a clamp driving device that advances and retracts the clamp to and from the rear-facing surface so as to hold an upper portion of the cloth between the clamp and the rear-facing surface and release the upper portion from therebetween.

Advantageous Effects of Invention

In the cloth spreading apparatus of the present invention, the pair of feeder chucks are engaged with adjacent corners of a washed piece of cloth at the lowered position, and raise this cloth to the traversing position of the spreading chucks. The pair of spreading chucks traverse to positions closer to each other to receive the adjacent corners of the cloth from the feeder chucks, and then traverse to positions farther away from each other to pull the adjacent corners so as to spread the cloth. The intermediate movable body receives, at the advanced position, an upper end portion of the spread cloth from the spreading chucks onto the upper surface and retains the upper end portion, and then releases the upper end portion of the cloth while moving to the retracted position so as to transfer the cloth onto the front part of the belt conveyor. The belt conveyor carries out the received cloth in a spread state.

For the intermediate movable body to receive, at the advanced position, the upper end portion of the spread cloth from the spreading chucks onto the upper surface and retain the upper end portion, the clamp driving device retracts the clamp in advance so as to be separated from the rear-facing surface, and when the upper end portion of the cloth is laid over the intermediate movable body from the front part to at least the rear-facing surface thereof, the clamp driving device advances the clamp so as to hold the upper end portion of the cloth between the clamp and the rear-facing surface. Here, the front part and the rear-facing surface of the upper surface of the intermediate movable body have different angles. Therefore, the pulling force applied from a portion of the cloth below the upper end portion thereof to the upper end portion changes direction on the rear-facing surface and is reduced by friction at a corner between the front part and the rear-facing surface, so that the upper end portion of the cloth is reliably held between the clamp and the rear-facing surface.

Thus, the cloth spreading apparatus of the present invention can securely retain a received piece of cloth and reliably transfer the cloth onto the belt conveyor at a predetermined position, in such cases as where an especially heavy piece of cloth is to be passed or where especially the operation speed is raised to enhance the efficiency of supplying cloth to an iron roller.

In the cloth spreading apparatus of the present invention, the clamp driving device may be a device that advances and retracts the clamp by swinging the clamp to and from the rear-facing surface. However, the clamp driving device is preferably a device that advances and retracts the intermediate movable body straight to and from the rear-facing surface. Thus, the height of protrusion of the clamp and the clamp driving device from the upper surface of the intermediate movable body can be reduced, and the configuration of the cloth spreading apparatus can be thereby made compact in the height direction.

In the cloth spreading apparatus of the present invention, in addition to the rear-facing surface and the clump, a negative pressure acting from an inside of the intermediate movable body on the upper surface is preferably used to retain the upper end portion of the cloth on the upper surface. Thus, a received piece of cloth can be retained more firmly and transferred more reliably onto the belt conveyor at a predetermined position.

DESCRIPTION OF EMBODIMENT

An embodiment of the present invention will be described below in detail based on the drawings. First, the basic structure of a cloth spreading apparatus A will be described based on FIG. 1 and FIG. 2.

The cloth spreading apparatus A is an apparatus used to turn a piece of cloth C into a shaped state of being hung down and neatly spread in a quadrangular shape, before being fed into a roll ironer etc. that is a processing device for the next process. The cloth C handled by this apparatus is pieces of cloth that have been washed and dried but have not yet been ironed, and have a quadrangular shape. The term quadrangular shape covers a square shape and a rectangular shape. Examples of such cloth C include sheets, bedding covers, and towels.

Figure 1:
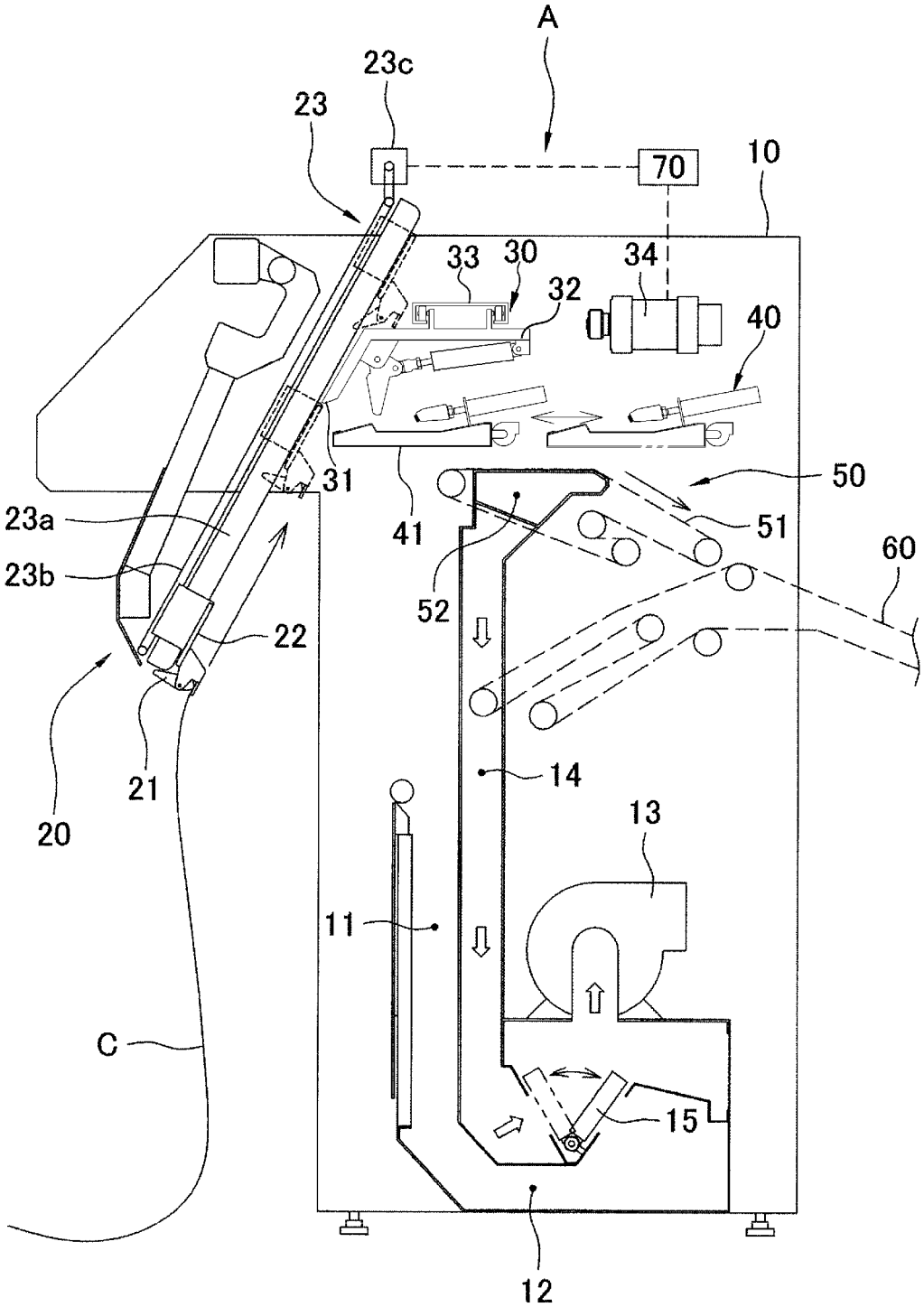
FIG. 1 is a sectional view (a sectional view taken along line I-I of FIG. 2) of a cloth spreading apparatus according to an embodiment of the present invention.
Figure 2:
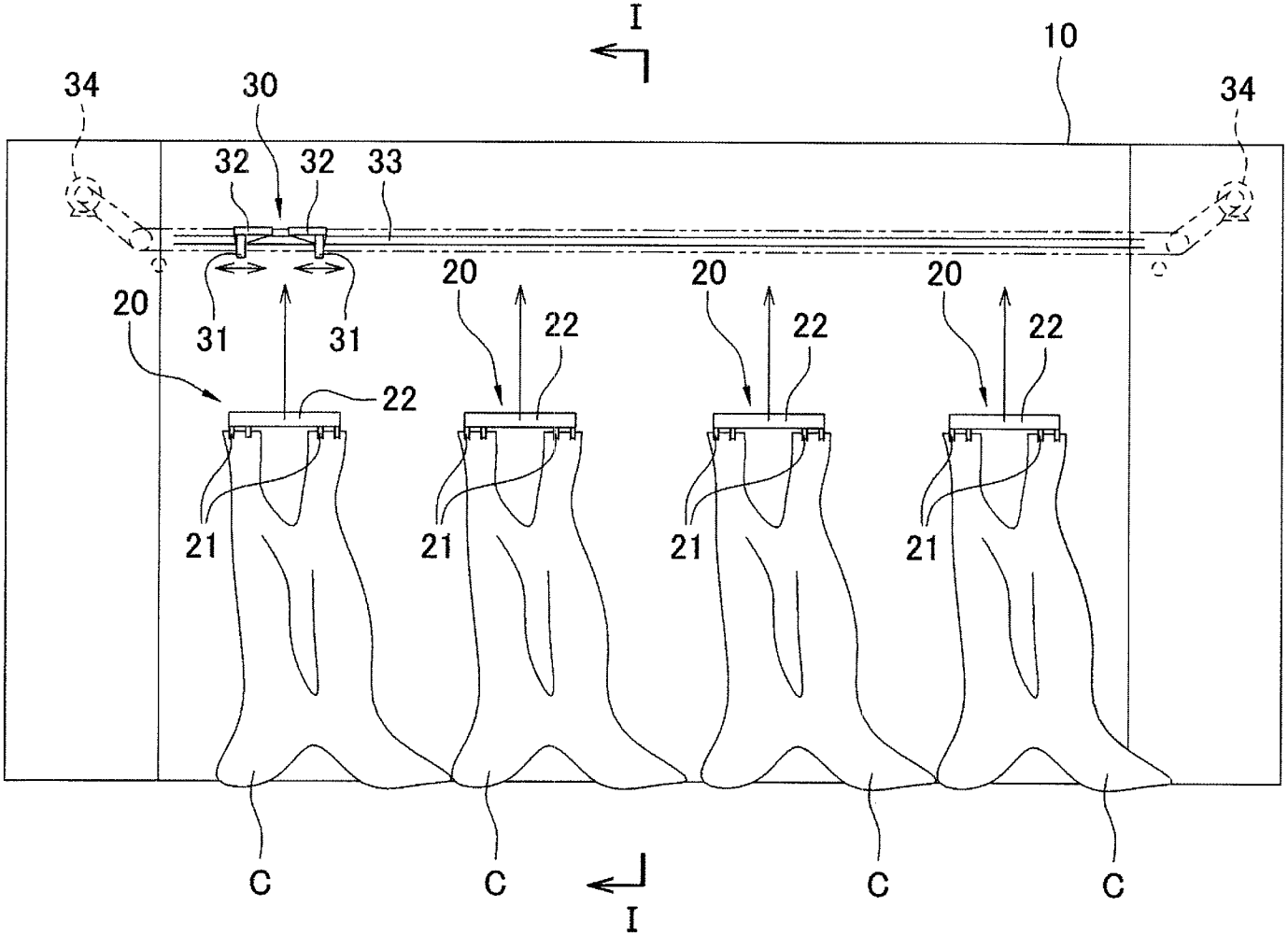
FIG. 2 is a front view of the cloth spreading apparatus.

Reference sign 10 in FIG. 1 denotes an apparatus main body, on a front side of which a feeder unit 20 is provided. The feeder unit 20 includes: a pair of feeder chucks 21, 21 that grasp corners at both ends of one side of the cloth C; a chuck base 22 to which the feeder chucks 21, 21 are fixed; and a raising-lowering device 23 that raises and lowers the chuck base 22. The pair of feeder chucks 21, 21 can be raised and lowered by the raising-lowering device 23. The chuck base 22 has a width approximately equivalent to a shoulder width of a person, and the feeder chucks 21, 21 are provided respectively at right and left ends of the chuck base 22. Each feeder chuck 21 is composed of two chucks disposed on right and left sides at a predetermined interval.

When a worker manually has a washed and dried piece of cloth C grasped by the feeder chucks 21, 21, the raising-lowering device 23 raises the cloth C along with the feeder chucks 21, 21 and passes the cloth C to a spreading unit 30 to be described later.

The cloth spreading apparatus A has one or more feeder units 20. In this embodiment, four feeder units 20 are provided, and the cloth C can be fed from any one of the feeder units 20.

In this embodiment, the raising-lowering device 23 is driven by an actuator capable of speed and position control. Examples of the "actuator capable of speed and position control" include a servo actuator, such as a servomotor or a servo cylinder, and a stepping motor. The raising-lowering device 23 in this embodiment is composed of a rod 23*a* that guides the chuck base 22 so as to move upward and downward, an endless belt 23*b* that is disposed along the rod 23*a* and fixed to the chuck base 22, and a servomotor 23*c* that drives a pulley, wound with the endless belt 23*b*, to rotate in normal and reverse directions.

The spreading unit 30 is provided at a position corresponding to an upper part of the raising-lowering device 23. The spreading unit 30 includes: a pair of spreading chucks 31, 31 that grasp corners at both ends of one side of the cloth C; a pair of carriages 32, 32 to each of which one spreading chuck 31 is fixed; a rail 33 that guides the carriages 32, 32 so as to move rightward and leftward; and a traversing device 34 that can separately move the carriages 32. For example, the traversing device 34 is formed by a combination of a servomotor and an endless belt. The traversing device 34 can cause the pair of spreading chucks 31, 31 to traverse separately. The traversing device 34 may also be configured to be driven by an actuator capable of speed and position control, other than a servomotor.

When the cloth C is raised by the action of the feeder unit 20, the spreading chucks 31 receive the cloth C from the feeder chucks 21 and grasp the corners of the cloth C. In this process, each spreading chuck 31 passes through a clearance between the two chucks composing the feeder chuck 21. Thus, the cloth C can be passed without interference between the spreading chucks 31 and the feeder chucks 21. Thereafter, the pair of spreading chucks 31, 31 traverse rightward and leftward so as to widen the interval therebetween, so that the cloth C can be spread and hung down.

A passer unit 40 is disposed below the spreading unit 30. The passer unit 40 includes a vacuum box 41 as an intermediate movable body that suctions and retains an upper end edge of the cloth C when a negative pressure is exerted, and an air cylinder, a servomotor, or the like (not shown) as an advancing-retracting device that advances and retracts the vacuum box 41.

Figure 3:
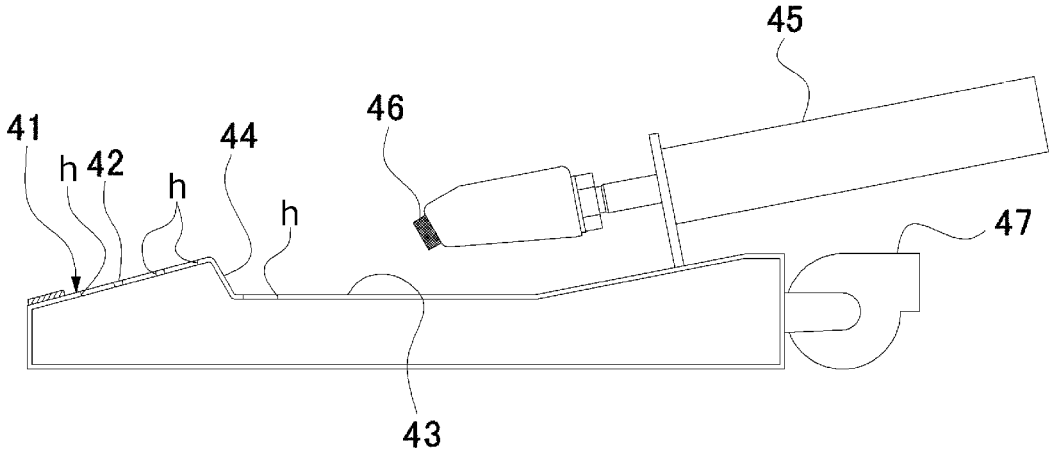
FIG. 3 is a side view showing a vacuum box of the cloth spreading apparatus.

As shown in FIG. 3, an upper surface of the vacuum box 41 has a front part 42 that is slightly inclined toward a front side, and a sunken part 43 that is located on a rear side of and one level lower than the front part 42. The vacuum box 41 has a rear-facing surface 44 that is slightly inclined upward (e.g., at about 30 degrees from a vertical direction), between the front part 42 and the sunken part 43, and further has an air cylinder 45 as a clamp driving device, on the upper surface on the rear side of the sunken part 43. The air cylinder 45 supports a clamp 46, formed by an elastic body, at a leading end of a piston rod, and can advance and retract the clamp 46 to and from the rear-facing surface 44 by advancing and retracting motions of the piston rod. In addition, the vacuum box 41 has, at a rear end thereof, a negative-pressure generator 47, such as a blower, that generates a negative pressure inside the vacuum box 41. A negative pressure generated by the negative-pressure generator 47 can be exerted on the upper surface through a large number of small holes h provided in the front part 42, the sunken part 43, and the rear-facing surface 44 of the upper surface.

A primary conveyor 50 formed by a belt conveyor is disposed below the passer unit 40. The primary conveyor 50 includes a conveyor belt 51 having a large number of small holes, and a vacuum box 52 disposed below a conveying surface of the conveyor belt 51. The primary conveyor 50 can deliver the cloth C toward the rear side while suctioning the cloth C. A secondary conveyor 60 formed by a belt conveyor is connected to the rear side of the primary conveyor 50, and the secondary conveyor 60 can deliver the cloth C to a processing device for the next process, for example, a roll ironer.

An airflow shaping section 11 is formed at a lower part of the front side of the apparatus main body 10. A lower part of the airflow shaping section 11 is connected to a blower 13 through a duct 12. A second duct 14 is formed behind the airflow shaping section 11. The duct 14 is configured to allow communication between the vacuum box 52 of the primary conveyor 50 and the blower 13. An opening-closing plate 15 is provided between the ducts 12, 14 and the blower 13. The opening-closing plate 15 alternatively opens and closes an opening of the duct 12 and an opening of the duct 14. Thus, it is possible to alternatively switch between a state where air is suctioned from the front side of the apparatus main body 10 into the airflow shaping section 11 and a state where the vacuum box 52 of the primary conveyor 50 is operated.

The cloth spreading apparatus A includes a control device 70 that controls the operations of the raising-lowering device 23 and the traversing device 34. The control device 70 is a computer composed of a CPU, a memory, and others. It is possible to move the feeder chucks 21 and the spreading chucks 31 in synchronization with each other by controlling the operations of the raising-lowering device 23 and the traversing device 34 by the control device 70. This will be described in detail later.

Next, the operation of the cloth spreading apparatus A will be described based on FIG. 4 to FIG. 7.

(I) Feeding Work

First, the feeder chucks 21 are on standby at a lowered feeding position. A worker finds corners at both ends of one side of the cloth C and has the corners respectively grasped by the feeder chucks 21, 21.

(II) Unfolding Action

Then, the feeder chucks 21 are raised to the highest position from the feeding position. At a passing position on the way at which the feeder chucks 21 coincide with the spreading chucks 31, the cloth C is passed from the feeder chucks 21 to the spreading chucks 31. Then, the pair of spreading chucks 31, 31 move rightward and leftward so as to widen the interval therebetween, so that the cloth C is hung down and spread and thus unfolded.

(III) Draw-In Action

Next, the opening-closing plate 15 is switched to create a state where air is suctioned into the airflow shaping section 11, so that the cloth C is drawn into the airflow shaping section 11 by a negative pressure.

(IV) Passing Action

Figure 4:
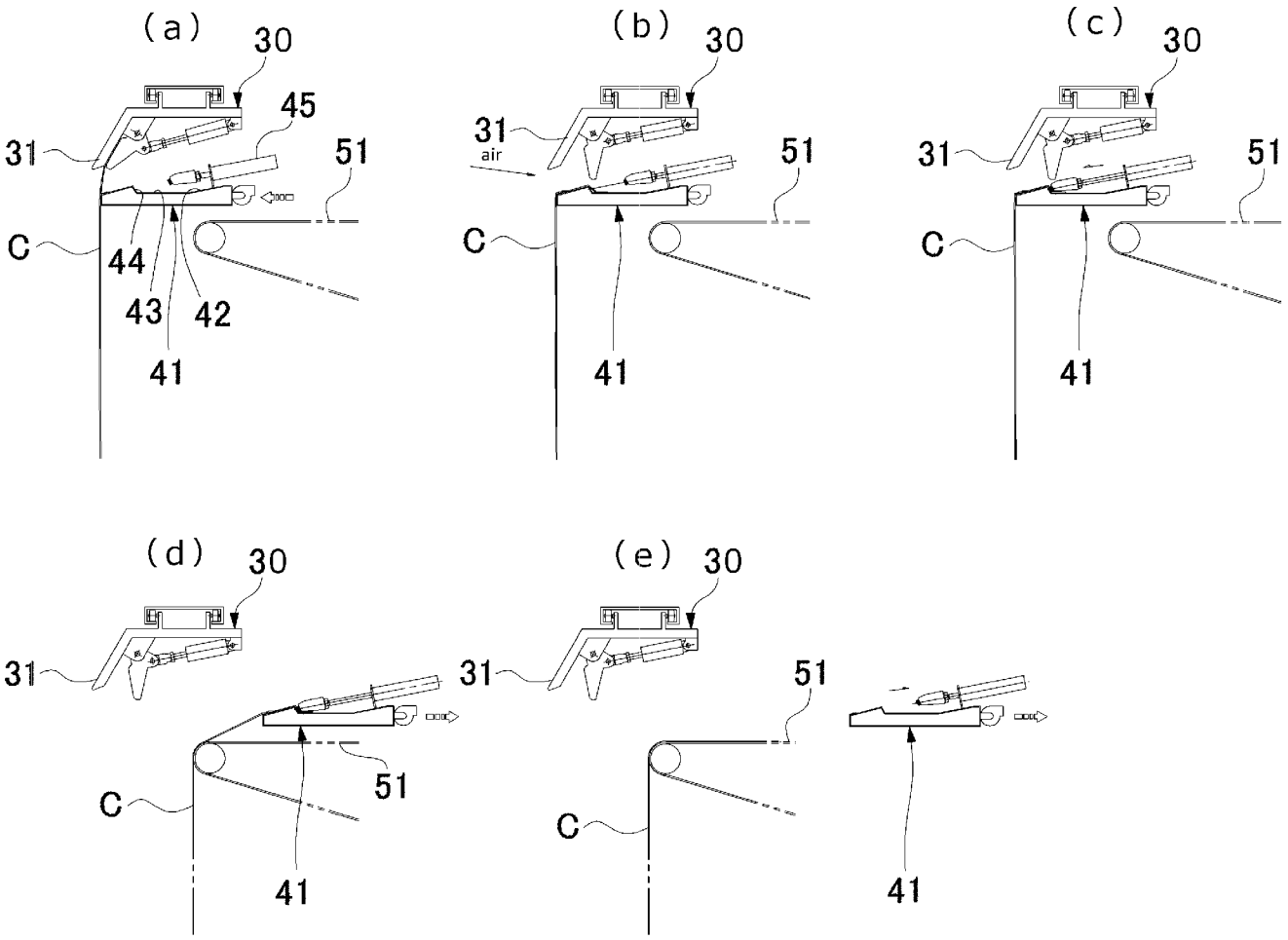
FIG. 4 is an operation chart showing the operation of the vacuum box of the cloth spreading apparatus.
Figure 5:
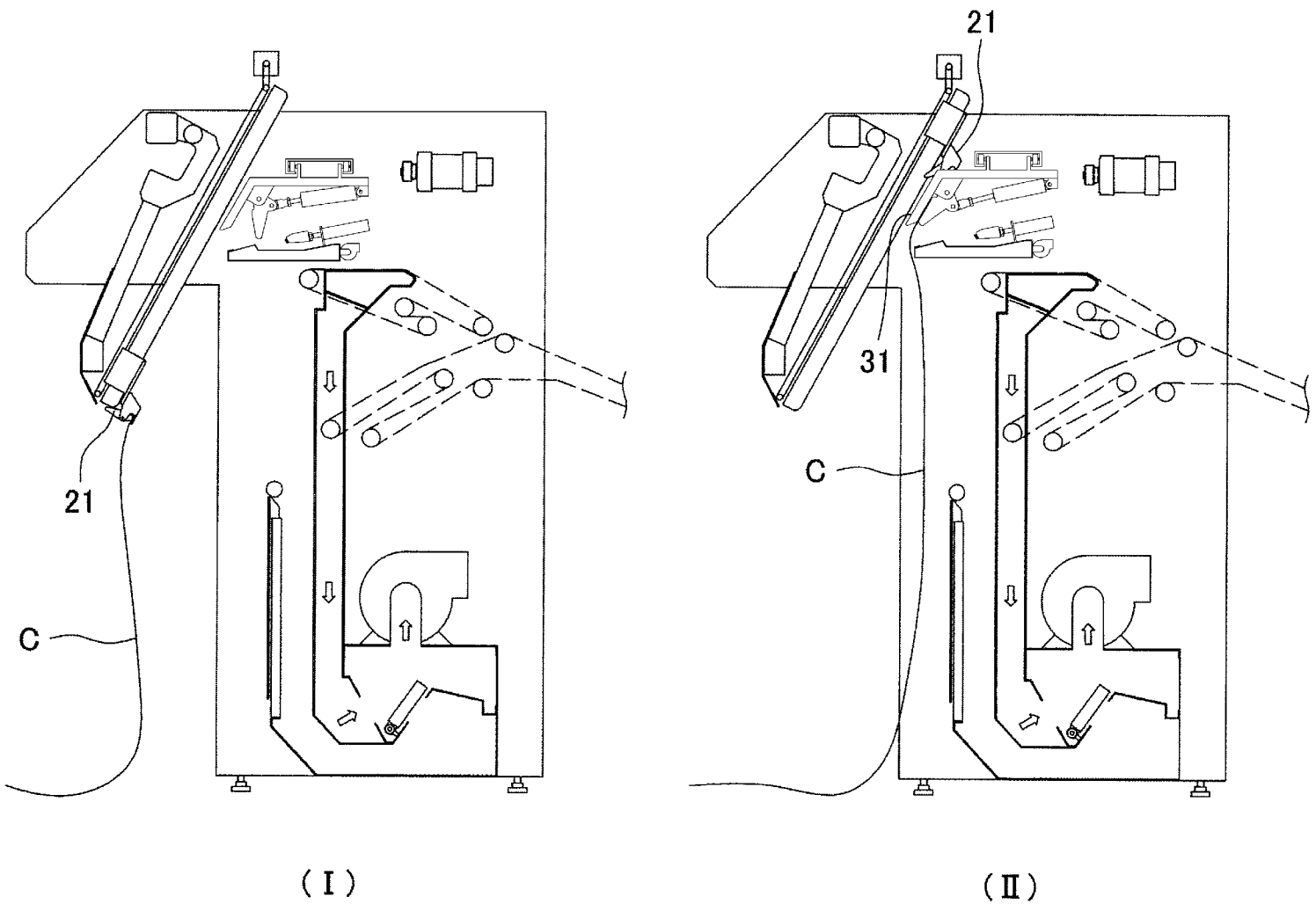
FIG. 5 is an operation chart showing steps (I) and (II) of the cloth spreading apparatus.
Figure 6:
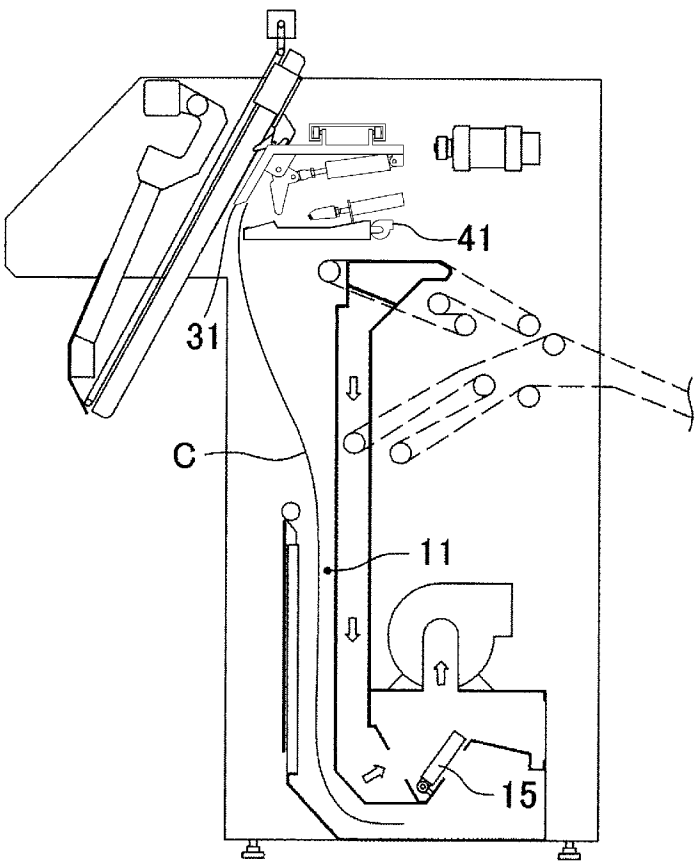
FIG. 6 is an operation chart showing steps (III) and (IV) of the cloth spreading apparatus.
Figure 6:
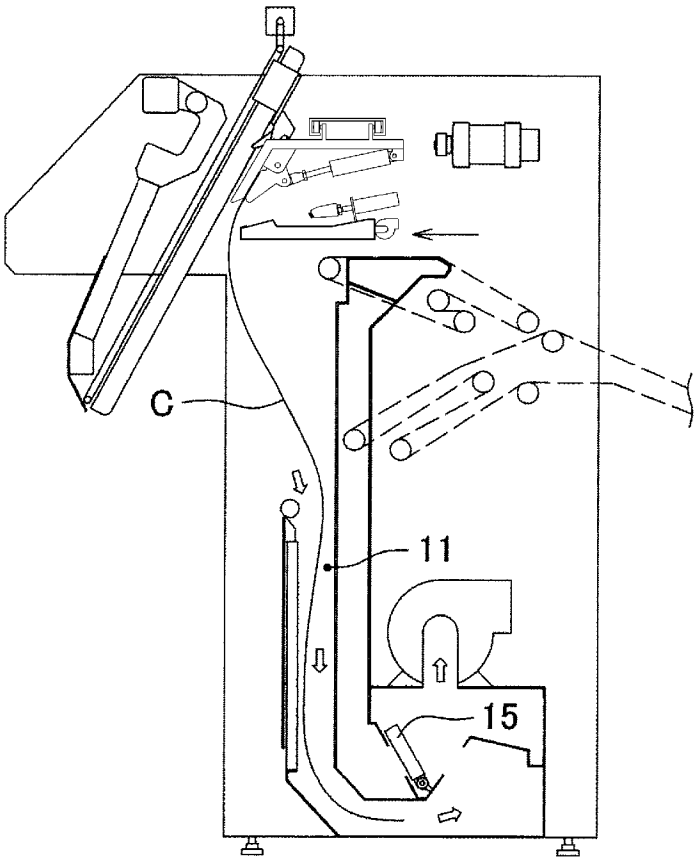
Figure 7:
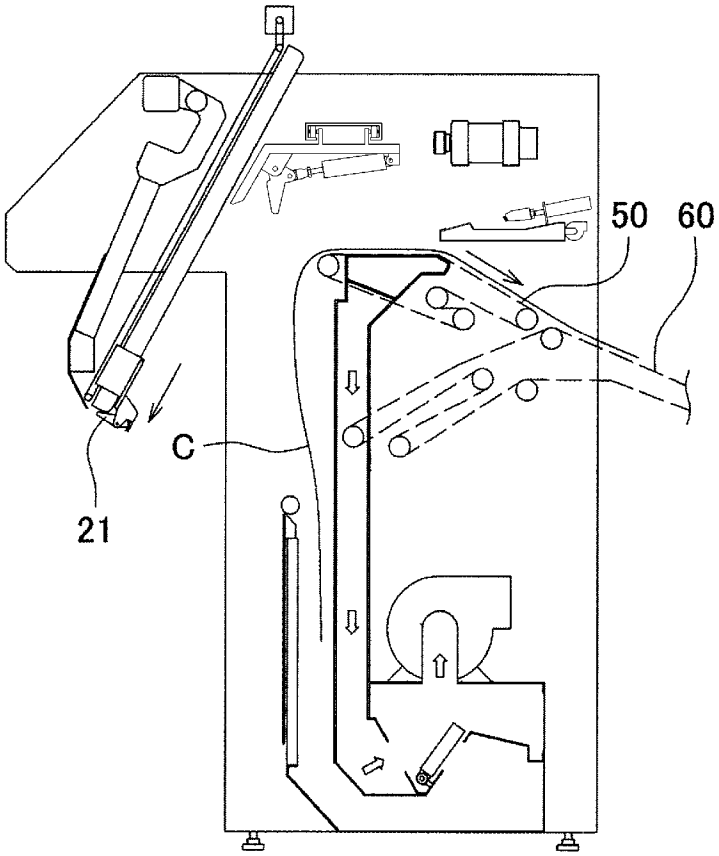
FIG. 7 is an operation chart showing steps (V) and (VI) of the cloth spreading apparatus.
Figure 7:
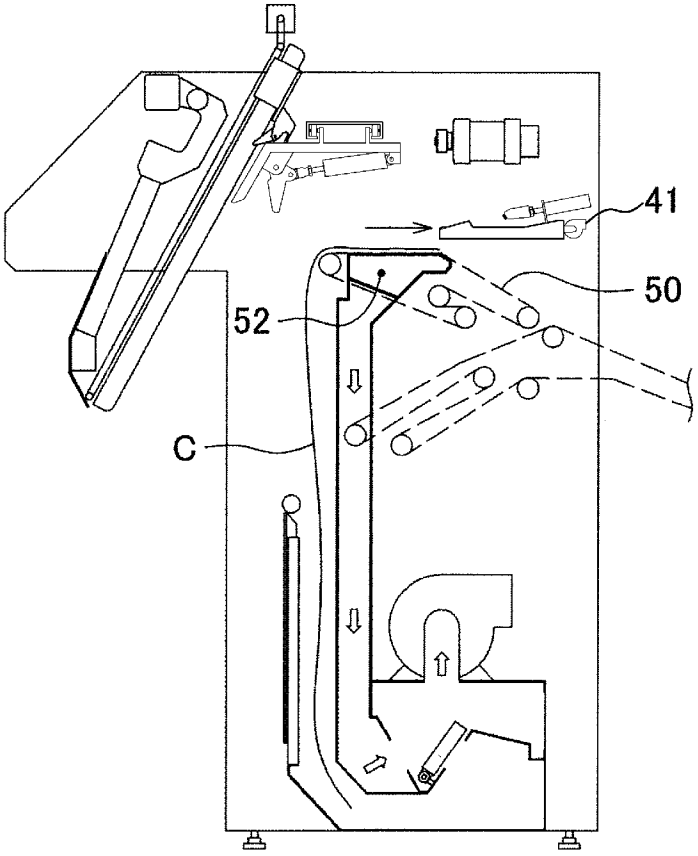

When the opening-closing plate 15 is switched again, the airflow inside the airflow shaping section 11 stops, so that the cloth C can be easily pulled up. In this state, as shown in FIG. 4(*a*), the vacuum box 41 is advanced into contact with the cloth C and the interval between the spreading chucks 31 is widened, and at the same time air is blown from the front side, for example. As a result, as shown in FIG. 4(*b*), the upper end portion of the cloth C is sucked onto the upper surface of the vacuum box 41 from the front part 42 to the sunken part 43. Then, as shown in FIG. 4(*c*), the clamp 46 is driven to advance by the air cylinder 45, so that the upper end portion of the cloth C is held between the clamp 46 and the rear-facing surface 44.

(V) Transit Action

Next, as shown in FIG. 4(*d*), an upper portion of the cloth C is pulled onto the primary conveyor 50 while the vacuum box 41 is retracted. Then, as shown in FIG. 4(*e*), the clamp 46 is retracted from the rear-facing surface 44 by the air cylinder 45 to release the upper end portion of the cloth C, so that the upper end portion of the cloth C makes a transit from the vacuum box 41 to the primary conveyor 50. During this process, the vacuum box 52 of the primary conveyor 50 is in operation.

(VI) Discharge Action

Next, the cloth C is moved from the primary conveyor 50 to the secondary conveyor 60, and is discharged to the processing device for the next process. The feeder chucks 21 are lowered to the feeding position.

Figure 8:
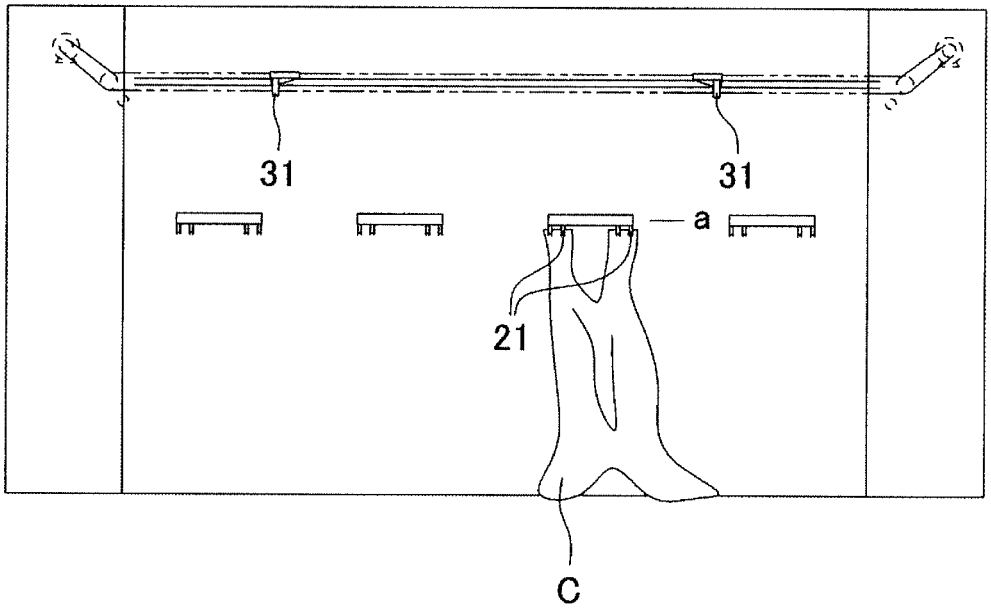
FIG. 8 is a detailed operation chart showing steps (1) and (2) of the cloth spreading apparatus.
Figure 8:
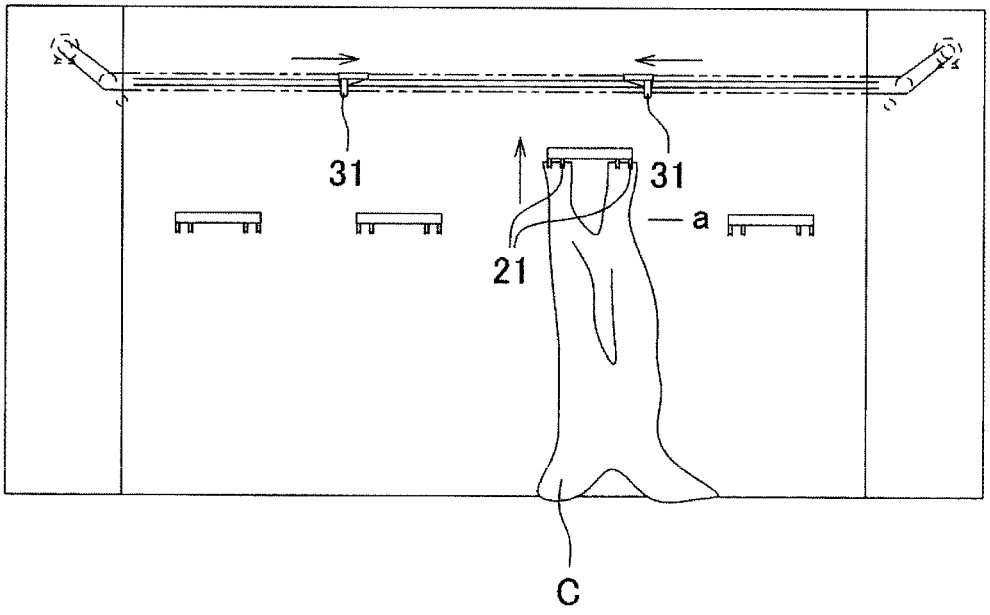
Figure 9:
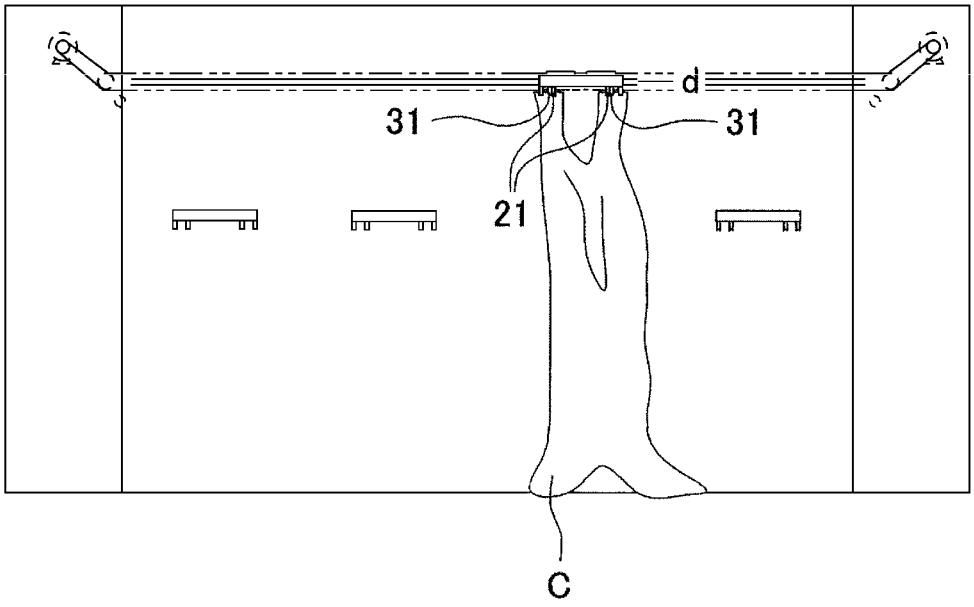
FIG. 9 is a detailed operation chart showing steps (3) and (4) of the cloth spreading apparatus.
Figure 9:
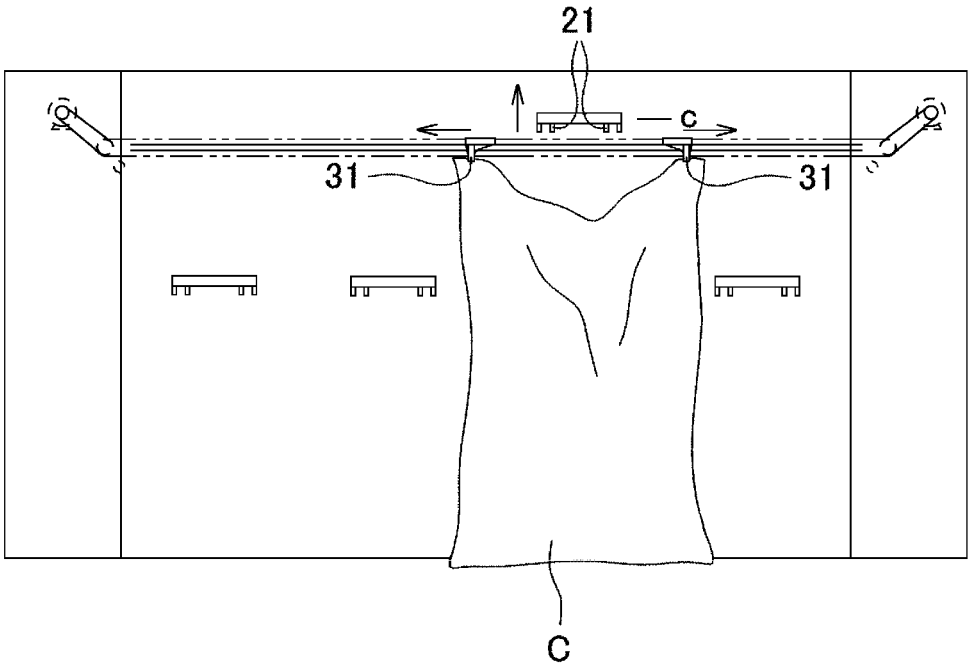
Figure 10:
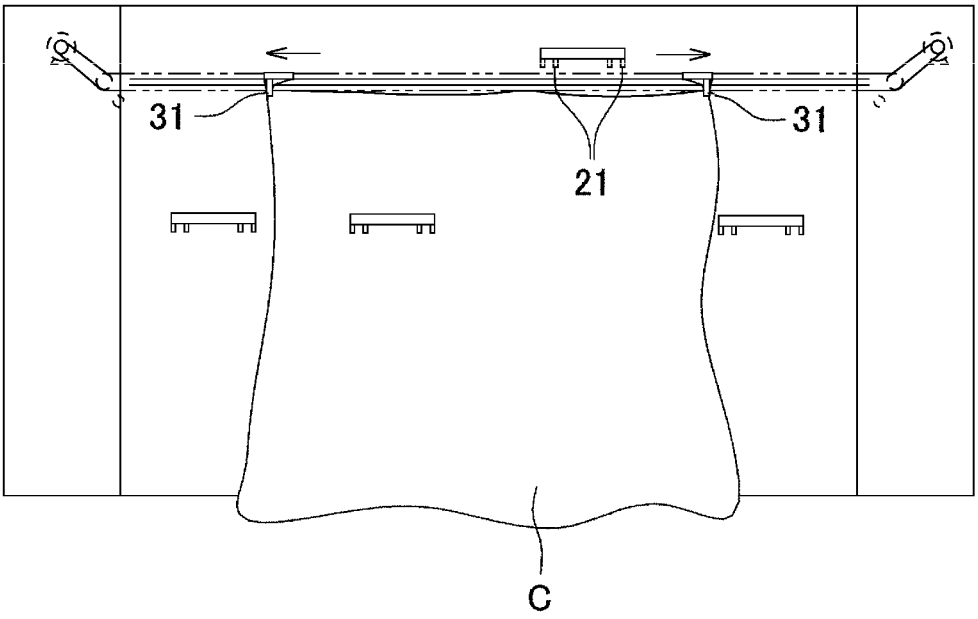
FIG. 10 is a detailed operation chart showing steps (5) and (6) of the cloth spreading apparatus.
Figure 10:
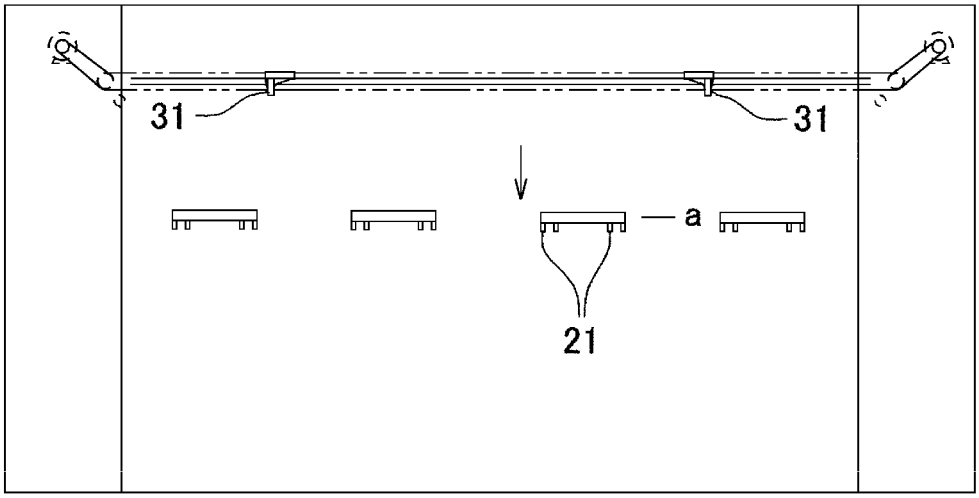

Next, the unfolding action among the above-described actions in the embodiment will be described in detail based on FIG. 8 to FIG. 10.

(1) First, the feeder chucks 21, 21 are on standby at a lowered feeding position a. Meanwhile, the spreading chucks 31, 31 are in the middle of the action of spreading another piece of cloth C or in a standby state after completion of the action. If in the standby state, the spreading chucks 31 are on standby at the same position as the position at which the cloth C has been spread rightward and leftward (the position in FIG. 8 (1)) or at a predetermined standby position. The worker finds corners at both ends of one side of the cloth C and has these corners respectively grasped by the feeder chucks 21, 21.

(2) When the cloth C is grasped by the feeder chucks 21, the control device 70 operates the raising-lowering device 23 and the traversing device 34 at the same time, and thereby raises the feeder chucks 21 from the feeding position a to a passing position d and causes the spreading chucks 31 to traverse to the passing position d.

(3) When both the feeder chucks 21 and the spreading chucks 31 arrive at the passing position d, the cloth C having been grasped by the feeder chucks 21 is passed to the spreading chucks 31.

In steps (2) and (3), the feeder chucks 21 and the spreading chucks 31 are moved at the same time. "Moved at the same time" here does not mean that the motions of these pairs of chucks have to be started and stopped at the same timing, as long as one pair of chucks are moved during a period of motion of the other pair of chucks.

The cloth spreading apparatus A has four feeder units 20, and the cloth C can be fed from any one of the feeder units 20. One spreading unit 30 is provided for these four feeder units 20, and pieces of cloth C fed into the respective feeder units 20 are sequentially processed. Therefore, at the time when a piece of cloth C is fed into one feeder unit 20, the spreading unit 30 may be in the middle of the action of passing or spreading another piece of cloth C having been fed into another feeder unit 20. In this case, the feeder chucks 21 may start to rise first and the spreading chucks 31 may start to traverse after completion of the action of spreading that other cloth C.

In this embodiment, each feeder chuck 21 is composed of two chucks disposed on the right and left sides at a predetermined interval. Each spreading chuck 31 passes through the clearance between the two chucks, so that the cloth C can be passed without interference between the spreading chucks 31 and the feeder chucks 21. To pass the cloth C, therefore, the feeder chucks 21 are moved so as to pass through the passing position d while the spreading chucks 31 are stopped at the passing position d. This requires the spreading chucks 31 to arrive at the passing position d earlier than the feeder chucks 21. In this case, the speeds of the feeder chucks 21 and the spreading chucks 31 may be adjusted such that the spreading chucks 31 arrive at the passing position d earlier, or such that the feeder chucks 21 stop temporarily at a position short of the passing position d.

(4) After the cloth C is passed, the control device 70 operates the raising-lowering device 23 and the traversing device 34 at the same time, and thereby raises the feeder chucks 21, 21 from the passing position d to a higher position c and causes the spreading chucks 31, 31 to traverse rightward and leftward from the passing position d.

(5) The pair of spreading chucks 31, 31 are moved rightward and leftward so as to widen the interval therebetween to thereby unfold the cloth C.

(6) After the cloth C is passed from the spreading chucks 31 to the passer unit 40, the feeder chucks 21 are lowered from the higher position c to the feeding position a.

Also in steps (4) and (5), the feeder chucks 21 and the spreading chucks 31 are moved at the same time. Also in this case, the motions of the feeder chucks 21 and the spreading chucks 31 do not have to be started and stopped at the same timing, as long as one pair of chucks are moved during a period of motion of the other pair of chucks. The spreading chucks 31 start to traverse after the feeder chucks 21 are raised to a position at which the feeder chucks 21 do not interfere with the spreading chucks 31. Since the traversing distance of the spreading chucks 31 is generally longer than the rising distance of the feeder chucks 21, the spreading chucks 31 still traverse after the feeder chucks 21 stop upon reaching the higher position c.

Thus, the cloth spreading apparatus A of this embodiment can spread a washed piece of cloth and carry out this cloth to a roll ironer etc., and the vacuum box 41 can securely retain a received piece of cloth and reliably transfer the cloth onto the primary conveyor 50 at a predetermined position, in such cases as where an especially heavy piece of cloth is to be passed or where especially the operation speed is raised to enhance the efficiency of supplying cloth to a roll ironer.

Moreover, in the cloth spreading apparatus of this embodiment, the clamp driving device is the air cylinder 45 that advances and retracts the clamp 46 straight to and from the rear-facing surface 44. Thus, the height of protrusion of the clamp 46 and the air cylinder 45 from the upper surface of the vacuum box 41 can be reduced, and the configuration of the cloth spreading apparatus A can be thereby made compact in the height direction.

Furthermore, in the cloth spreading apparatus of this embodiment, in addition to the rear-facing surface 44 and the clamp 46, a negative pressure generated by the negative-pressure generator 47 and acting from the inside of the vacuum box 41 on the upper surface is used to retain the upper end portion of the cloth C on the upper surface. Thus, a received piece of cloth can be retained more firmly and transferred more reliably onto the primary conveyor 50 at a predetermined position.

While the present invention has been described above based on the example shown in the drawings, the invention is not limited to the above example but can be appropriately modified within the scope described in the claims. For example, the clamp driving device may be a device that advances and retracts the clamp to and from the rear-facing surface by swinging the clamp, instead of a device that advances and retracts the clamp straight to and from the rear-facing surface. The rear-facing surface 44 can be set to an arbitrary inclination angle, and may be vertical.

INDUSTRIAL APPLICABILITY

As has been described above, the cloth spreading apparatus of the present invention can securely retain a received piece of cloth and reliably transfer the cloth onto the belt conveyor at a predetermined position, in cases such as where an especially heavy piece of cloth is to be passed or where especially the operation speed is raised to enhance the efficiency of supplying cloth to an iron roller.

REFERENCE SIGNS LIST

A Cloth spreading apparatus
C Cloth
10 Apparatus main body

20 Feeder unit
21 Feeder chuck
22 Chuck base
23 Raising-lowering device
23*a* Rod
23*b* Endless belt
23*c* Servomotor
30 Spreading unit
31 Spreading chuck
32 Carriage
33 Rail
34 Traversing device
41 Passer unit
42 Vacuum box
43 Front part
43 Sunken part
44 Rear-facing surface
45 Air cylinder
46 Clamp
47 Negative-pressure generator
50 Primary conveyor
60 Secondary conveyor
70 Control device

The invention claimed is:

1. A cloth spreading apparatus which comprises: a pair of feeder chucks that grasp adjacent corners of a washed piece of cloth; a raising-lowering device that raises and lowers the pair of feeder chucks; a pair of spreading chucks that receive the cloth from the pair of feeder chucks at a raised position of the feeder chucks and grasp the adjacent corners of the cloth; a traversing device that causes the pair of spreading chucks to traverse; an intermediate movable body on an upper surface of which an upper end portion of the cloth is retained; an advancing-retracting device that advances and retracts the intermediate movable body; and a belt conveyor that carries out the spread cloth, and in which the pair of feeder chucks are engaged with adjacent corners of a washed piece of cloth at a lowered position, and raise the cloth to a traversing position of the spreading chucks; the pair of spreading chucks traverse to positions closer to each other to receive the adjacent corners of the cloth from the feeder chucks, and then traverse to positions farther away from each other to pull the adjacent corners so as to spread the cloth; the intermediate movable body receives, at an advanced position, an upper end portion of the spread cloth from the spreading chucks onto the upper surface and retains the upper end portion, and then releases the upper end portion of the cloth while moving to a retracted position so as to transfer the cloth onto a front part of the belt conveyor; and the belt conveyor carries out the received cloth in a spread state, wherein the intermediate movable body has:

a rear-facing surface that is a part of the upper surface between a front part and a sunken part located at a lower level than the front part, and that extends downward from the front part toward the sunken part;

a clamp that is placed opposite to the rear-facing surface; and a clamp driving device that advances and retracts the clamp to and from the rear-facing surface so as to hold an upper portion of the cloth between the clamp and the rear-facing surface and release the upper portion from therebetween.

2. The cloth spreading apparatus according to claim 1, wherein the clamp driving device advances and retracts the clamp straight to and from the rear-facing surface.

3. The cloth spreading apparatus according to claim 1, wherein, in addition to the rear-facing surface and the clamp, a negative pressure acting from an inside of the intermediate movable body on the upper surface is used to retain the upper end portion of the cloth on the upper surface.

4. The cloth spreading apparatus according to claim 2, wherein, in addition to the rear-facing surface and the clamp, a negative pressure acting from an inside of the intermediate movable body on the upper surface is used to retain the upper end portion of the cloth on the upper surface.

* * * * *